United States Patent [19]

Gulla et al.

[11] 4,124,399

[45] Nov. 7, 1978

[54] STABILIZED ELECTROLESS PLATING SOLUTIONS

[75] Inventors: Michael Gulla, Sherborn; Christy Savas, Framingham, both of Mass.

[73] Assignee: Shipley Company Inc., Newton, Mass.

[21] Appl. No.: 832,937

[22] Filed: Sep. 13, 1977

[51] Int. Cl.[2] ..... C23C 3/02

[52] U.S. Cl. ..... 106/1.23; 106/1.26; 427/430 A; 427/437

[58] Field of Search ..... 106/1.23, 1.26; 427/437, 430 A

[56] References Cited

U.S. PATENT DOCUMENTS

| | | | |
|---|---|---|---|
| 3,615,737 | 10/1971 | Schneble et al. | 106/1.23 |
| 3,650,777 | 3/1972 | Schneble et al. | 106/1.23 |

*Primary Examiner*—Lorenzo B. Hayes
*Attorney, Agent, or Firm*—Robert L. Goldberg

[57] ABSTRACT

An electroless copper plating solution is characterized by the addition of a small but effective amount of a source of gallium ions for improved stability alone or in combination with a secondary stabilizer.

10 Claims, No Drawings

STABILIZED ELECTROLESS PLATING SOLUTIONS

BACKGROUND OF THE INVENTION

1. Field of the Invention

This invention relates to an electroless copper plating solution having improved stability characterized by the addition of a stabilizer comprising a source of gallium alone or in combination with an additional stabilizer.

2. Description of the Prior Art

Electroless metal deposition refers to the chemical plating of a metal over an active surface by chemical reduction in the absence of an external electric current. Processes and compositions useful therefor are known, are in substantial commercial use, and are described in numerous publications, including U.S. Pat. Nos. 2,938,805; 3,011,920; and 3,383,224 included herein by reference.

Known electroless copper deposition solutions generally comprise four major ingredients dissolved in solvent, usually water. They are (1) a source of the copper ions, (2) a reducing agent such as formaldehyde, (3) an acid or hydroxide pH adjuster to provide required pH, and (4) a complexing agent for copper ions sufficient to prevent their precipitation in solution.

In addition to the aforesaid major components of an electroless copper solution, it is known that other additives are needed for a commercially useful formulation, for example, to stabilize the solution and improve deposit properties. As to stabilizing the solution, it is known that certain additives added to an electroless copper solution in properly controlled trace quantities act as stabilizers and retard the rate of bath decomposition. Generally, these additives, or stabilizers as they are referred to in the art, are catalytic poisons. The concentration of the stabilizer in solution is usually critical. Trace quantities, typically in the range of a few parts per million, provide stability. An excess of stabilizer may partially or totally stop deposition of the electroless copper.

STATEMENT OF THE INVENTION

The present invention is based upon the discovery that the addition of a small but effective amount of a source of gallium to an electroless copper solution improves stability without substantially retarding the rate of deposition. Moreover, it has been found that the addition of a combination of gallium with another stabilizer results in substantially increased stability. Accordingly, the present invention provides an electroless copper deposition solution comprising (1) a source of copper ions, (2) a reducing agent therefor such as formaldehyde, (3) a pH adjuster, (4) a complexing agent for the copper ions sufficient to prevent their precipitation in solution, and (5) a stabilizer for the solution which may be a source of gallium alone or in combination with another stabilizer.

DESCRIPTION OF THE PREFERRED EMBODIMENTS

As noted above, gallium improves bath stability. The term gallium as used herein is not intended to be limited to gallium metal, but rather is intended to mean gallium present in the plating solution regardless of its physical or chemical form. In this respect, in an alkaline solution containing formaldehyde, a strong reducing agent, the addition of an ionizable gallium compound would probably cause the gallium to be present in a dispersed hydrolized form. Both simple and complex gallium compounds are suitable provided the compound does not contain an anion detrimental to the plating solution. Typical examples of gallium compounds include gallium acetate, gallium bromide, gallium chloride, gallium sulphate, gallium ammonium chloride and complexes such as the complex of gallium and ethylene diamine tetraacetic acid. The preferred gallium compound is gallium nitrate.

Gallium, in a low concentration, is not a catalytic poison as are sulfur and cyanide compounds and therefore, the gallium concentration in solution is not critical. Frequently, the required amount of gallium is very much dependent upon the particular solution to which the gallium is added. Therefore, some routine experimentation may be required to optimize the concentration of the gallium. In general, for purposes of setting forth guidelines, a preferred range comprises from about 10 to 1000 parts per million and a more preferred range comprises from 250 to 750 parts per million.

Gallium is not a strong stabilizer as are, for example, sulfur compounds. Therefore, in a preferred embodiment, the gallium is used in combination with another stabilizer. Perhaps the most widely used group of known stabilizers are divalent sulphur-containing compounds, many of which are disclosed in U.S. Pat. No. 3,361,540 incorporated herein by reference. Representative examples of such sulphur compounds are disclosed in said patent.

The amount of the sulfur compound that may be used in combination with gallium is small and will vary depending upon the particular compound used. Generally the amount may vary from a trace to about 100 parts per million parts of solution.

Other stabilizers that may be used with gallium include, for example, the water soluble cyanide compounds described in U.S. Pat. No. 3,310,340. Typical of such compounds are alkali metal cyanides such as sodium and potassium cyanide. The cyanide compound is used in an amount about equal to that of the divalent sulfur compound.

An additional class of stabilizers is disclosed in U.S. Pat. No. 3,457,089. These stabilizers comprise acetylinic compounds corresponding to one of the following formulas:

$$R{-}C{\equiv}CH \text{ or } R{-}C{\equiv}C{-}R$$

where each R is individually selected from the class of lower monovalent hydroxyalkyl, cyclohydroxyalkyl or hydroxyalkyl ether. Examples of suitable materials are disclosed in said patent.

With the exception of the gallium compound, the electroless copper solution conforms to the prior art. Since such solutions are known, their compositions need not be discussed in further detail herein.

The solutions of the invention are used to deposit copper in conventional manner. The surface of a part to be plated should be free of grease and contaminating material. Next, the surface to receive the metal deposit is sensitized to render it catalytic to the reception of the electroless metal as by the well-known treatment of contact with a colloid of palladium having a protective stannic acid colloid. Thereafter, following known rinsing steps and the like, the part is immersed in the plating solution at a temperature dependent upon the solution used for a time sufficient to provide a deposit of desired thickness.

The invention will be better understood by reference to the following examples where stability of solution was measured by the time a bath spontaneously decomposes (triggers) when plating catalyzed cloth at one-eighth square foot per liter. Catalyzed cloth is cloth immersed in Catalyst 6F of Shipley Company Inc.

EXAMPLES 1 TO 8

| | |
|---|---|
| Cupric sulfate pentahydrate (gm) | 8 |
| Formaldehyde (gm) | 7.5 |
| Sodium/potassium tartrate (gm) | 40 |
| Sodium hydroxide (gm) | 17 |
| Water | to 1 liter |

Catalyzed cloth was plated with the above formulation at room temperature with gallium nitrate added in amounts and with results as set forth in the following table:

| Example No. | Amount (ppm) | Time(min) |
|---|---|---|
| 1 | 0 | 45 |
| 2 | 5 | 45 |
| 3 | 25 | 45 |
| 4 | 50 | 45 |
| 5 | 100 | 45 |
| 6 | 250 | 90 |
| 7 | 500 | 50 |
| 8 | 1000 | 85 |

The above results show an improvement with gallium. It should be noted that the results set forth above are approximate as they are based upon visual observation.

EXAMPLES 9 TO 18

The procedure of the above examples was repeated using gallium in combination with other stabilizers with results as set forth in the following table:

| | Stabilizer(ppm) | | | | |
|---|---|---|---|---|---|
| Example No. | Gallium Nitrate | Potassium Ferrocyanide Trihydrate | Ethynol Cyclo Hexanol | Methyl Butynol | Time (min) |
| 9 | 0 | 0 | 0 | 0 | 30 |
| 10 | 500 | 0 | 0 | 0 | 55 |
| 11 | 0 | 266 | 0 | 0 | 75 |
| 12 | 0 | 0 | 10 | 0 | 70 |
| 13 | 0 | 0 | 0 | 35 | 75 |
| 14 | 500 | 266 | 0 | 0 | 100 |
| 15 | 500 | 0 | 10 | 0 | 95 |
| 16 | 500 | 0 | 0 | 35 | 100 |
| 17 | 500 | 266 | 10 | 35 | >120 |
| 18 | 0 | 266 | 10 | 35 | >120 |

From the above, it can be seen that gallium alone in the formulation was not as good a stabilizer as other prior art stabilizers, but in combination with other stabilizers, provide solutions of excellent stability.

EXAMPLES 19 TO 26

| | |
|---|---|
| Cupric sulfate pentahydrate (gm) | 8 |
| Formaldehyde (gm) | 7.5 |
| Pentahydroxypropyl diethylene triamine (gm) | 20 |

-continued

| | |
|---|---|
| Sodium hydroxide (gm) | 17 |
| Water | to 1 liter |

A gallium stabilizer solution was prepared by dissolving metallic gallium in boiling hydrochloric acid for 24 hours, cooling and neutralizing with caustic to pH 13. This provides a source of gallium stabilizer that is lower in cost. Gallium, so prepared, is added in varying amounts as set forth in the following table where the gallium concentration is expressed as metallic gallium.

| Example No. | Amount (ppm) | Time (min) |
|---|---|---|
| 19 | 0 | 13 |
| 20 | 1 | 22 |
| 21 | 7 | 20 |
| 22 | 14 | 22 |
| 23 | 27 | 22 |
| 24 | 68 | 22 |
| 25 | 137 | 20 |
| 26 | 273 | 28 |

As in the previous examples, gallium prolongs the life of the solution.

We claim:

1. In an aqueous electroless copper plating solution including a source of cupric ions, a complexing agent sufficient to render said cupric ions soluble in solution, a pH adjustor and a reducing agent for said cupric ions; the improvement comprising gallium in said solution in an amount capable of providing increased bath stability.

2. In a basic aqueous electroless copper plating solution including a source of cupric ions, a complexing agent sufficient to render said cupric ions soluble in solution, free hydroxide and formaldehyde as a reducing agent for said cupric ions, the improvement comprising the addition of gallium to the solution in an amount of at least one part per million parts of solution to provide increased bath stability.

3. The solution of claim 2 where the gallium is derived from a gallium salt having an anionic portion non-interfering with said electroless plating solution.

4. The solution of claim 2 where the gallium is in an amount varying from 1 to 1000 parts per million parts of solution.

5. The solution of claim 4 where the amount varies from 100 to 750 parts per million parts.

6. The solution of claim 2 containing an additional stabilizing agent selected from the group consisting of divalent sulphur compounds, cyanide compounds and acetylinic compounds.

7. The solution of claim 6 where the additional stabilizer is an alkali metal cyanide.

8. The solution of claim 6 where the additional stabilizer is a thio compound.

9. A method for increasing the stability of an electroless copper plating solution comprising a source of cupric ions, a complexing agent sufficient to render said cupric ions soluble in solution, a pH adjustor and a reducing agent for said cupric ions, said method comprising the step of adding a gallium compound to said solution in a concentration sufficient to improve stability.

10. The method of claim 9 where the solution contains an additional stabilizer.

* * * * *